US007597724B2

(12) United States Patent
Cracknell

(10) Patent No.: US 7,597,724 B2
(45) Date of Patent: Oct. 6, 2009

(54) GASOLINE COMPOSITION

(75) Inventor: Roger Francis Cracknell, Chester (GB)

(73) Assignee: Shell Oil Company, Houston, TX (US)

( * ) Notice: Subject to any disclaimer, the term of this patent is extended or adjusted under 35 U.S.C. 154(b) by 663 days.

(21) Appl. No.: 10/870,361

(22) Filed: Jun. 17, 2004

(65) Prior Publication Data

US 2005/0279018 A1 Dec. 22, 2005

(30) Foreign Application Priority Data

Jun. 18, 2003 (EP) ..... 03253829

(51) Int. Cl.
*C10L 1/10* (2006.01)
*C10L 1/18* (2006.01)

(52) U.S. Cl. ..... 44/300; 44/451; 585/14

(58) Field of Classification Search ..... 44/300, 44/451; 585/14; 208/16
See application file for complete search history.

(56) References Cited

U.S. PATENT DOCUMENTS

| | | | | |
|---|---|---|---|---|
| 5,288,393 | A | 2/1994 | Jessup et al. | 208/16 |
| H001305 | H * | 5/1994 | Townsend et al. | 44/449 |
| 5,593,567 | A | 1/1997 | Jessup et al. | 208/46 |
| 5,653,866 | A | 8/1997 | Jessup et al. | 208/46 |
| 5,837,126 | A | 11/1998 | Jessup et al. | 208/16 |
| 5,855,629 | A | 1/1999 | Grundy et al. | 44/400 |
| 6,030,521 | A | 2/2000 | Jessup et al. | 208/17 |
| 6,039,772 | A | 3/2000 | Orr | 44/359 |
| 6,290,734 | B1 | 9/2001 | Scott et al. | 44/451 |
| 2002/0045785 | A1 | 4/2002 | Bazzani et al. | 585/14 |
| 2002/0068842 | A1 | 6/2002 | Brundage et al. | 585/14 |
| 2002/0143216 | A1 | 10/2002 | Tsurutani et al. | 585/14 |
| 2003/0094397 | A1 * | 5/2003 | Ignatius et al. | 208/16 |

FOREIGN PATENT DOCUMENTS

| | | |
|---|---|---|
| DE | 199 55 651 A1 | 5/2001 |
| WO | WO0077130 | 12/2000 |
| WO | WO 02/16531 | 2/2002 |
| WO | WO0231090 | 4/2002 |
| WO | WO 03/016438 | 2/2003 |

OTHER PUBLICATIONS

International Search Report for PCT/EP2004/051160 of Sep. 30, 2007.
SAE Paper 922218, Field Trial to Investigate the Effect of Fuel Composition and Fuel-Lubricant Interaction on Sludge Formation in Gasoline Engines, by I. R. Galliard and J. R. F. Lillywhite, International Fuels and Lubricants Meeting and Exposition San Francisco, California, Oct. 19-22, 1992.
Kirk-Othmer, "Encyclopedia of Chemical Technology," 4th Ed. vol. 4, p. 725.
Vance R. Kopp et al., "Heavy Hydrocarbon/Volatility Study: Fuel Blending and Analysis for the Auto/Oil Air Quality Improvement Research Program," SAE Technical Papers Series, 930143, 1993.
R. H. Pahl et al., "Fuel Blending and Analysis for the Auto/Oil Air Quality Improvement Research Program," SAE Technical Papers Series, 902098, Oct. 22, 1990.
Frank S. Gerry et al., Test Fuels: Formulation and Analyses - The Auto/Oil Air Quality Improvement Research Program, SAE Technical Papers Series, 92032, Feb. 24, 1992.
"BP Produces Ethanol/Petrol Blend in Australia," Reuters, Aug. 22, 2002.
Mike Roarty et al., Current Issues Brief No. 12 2002-03, "Fuel Ethanol-Background and Policy Issues," Parliament of Australia, Parliamentary Library, Feb. 10, 2003.

* cited by examiner

*Primary Examiner*—Cephia D Toomer

(57) ABSTRACT

A gasoline composition is provided containing a hydrocarbon base fuel containing 5 to 20% v olefins, not greater than 5% v olefins of at least 10 carbon atoms, not greater than 5% v aromatics of at least 10 carbon atoms, initial boiling point in the range 24 to 45° C., $T_{10}$ in the range 38 to 60° C., $T_{50}$ in the range 77 to 110° C., $T_{90}$ in the range 130 to 190° C. and final boiling point not greater than 220° C. A method of operating an automobile using such gasoline composition as fuel is provided. Use of such gasoline composition as fuel provides improved stability of engine lubricant with reduced frequency of engine oil changes.

11 Claims, No Drawings

GASOLINE COMPOSITION

This invention relates to gasoline compositions and their use.

SAE Paper 922218, I. R. Galliard and J. R. F. Lillywhite, "Field Trial to Investigate the Effect of Fuel Composition and Fuel-Lubricant Interaction on Sludge Formation in Gasoline Engines", SAE International Fuels and Lubricant Meeting and Exposition, San Francisco, Calif., USA, Oct. 19-22, 1992, describes vehicle tests on eight fuels, four of which were base fuels and four had detergent added. All of the fuels contained 0.15 g/l of lead. The four base fuels were characterised as follows:—

(i) 45% v aromatics, 55% v saturates, final boiling point (FBP) 182° C., sulphur less than 50 ppmw, (ii) 53% v aromatics, 1% v olefins, 46% saturates, FBP 211° C., sulphur less than 50 ppmw, (iii) 38% v aromatics, 30% v olefins, 32% v saturates, FBP 174° C. sulphur 260 ppmw, and (iv) 31% v aromatics, 30% v olefins, 39% v saturates, FBP 208° C., sulphur 180 ppmw.

Vehicle tests were carried out, using all eight fuels, and two different lubricants, one meeting API SF rating (low dispersant) and the other meeting API SG rating (high dispersant). In the conclusions, it is stated that there were significant fuel, lubricant and fuel-lubricant interaction effects on the propensity to form sludge in a modern gasoline engine; lubricant dispersant level is a significant parameter to control the onset of sludge formation; fuel end-point, the presence of fuel detergent, and the presence of heavy aromatic fuel components are all significant parameters in the control of sludge, with high end-point fuels having a large amount of heavy aromatic components and containing no gasoline detergent additives showing the most marked sludge formation tendencies. The trial showed no correlation between levels of sludge and levels of wear. It is also stated that no correlation was found between levels of cam wear or used oil iron levels and sludge control performance.

WO-A-02016531 describes an unleaded gasoline composition comprising a major amount of hydrocarbons boiling in the range from 30° C. to 230° C. and 2% to 20% by volume, based on the gasoline composition, of diisobutylene, the gasoline composition having Research Octane Number (RON) in the range 91 to 101, Motor Octane Number (MON) in the range 81.3 to 93, and relationship between RON and MON such that (*a*) when $101 \geqq RON > 98$, $(57.65+0.35\ RON) \geqq MON > (3.2\ RON-230.2)$, and (*b*) when $98 \geqq RON \geqq 91$, $(57.65+0.35\ RON) \geqq MON \geqq (0.3\ RON+54)$, with the proviso that the gasoline composition does not contain a MON-boosting aromatic amine optionally substituted by one or more halogen atoms and/or $C_{1-10}$ hydrocarbyl groups.

In spark-ignition engines equipped with a knock sensor, such gasoline compositions are capable of producing advantageous power outputs.

From the data given in WO-A-02016531, it can readily be seen that only the fuel blends of Examples 1 to 11 represent gasoline compositions wherein the olefin content is 5% or greater. For these gasoline compositions, although no values are given for $T_{10}$, for Examples 1 to 3 it is clear that $T_{10}$ values must be at last 98° C., since each of these contains more than 10% v n-heptane (b.p. 98° C.), and, by volume interpolation from the information on the blend compositions given in WO-A-0201653, the person skilled in the art can derive respective $T_{10}$ values for Examples 4 to 11 as follows:— Example 4, 78° C.; Example 5, 75° C.; Example 6, 74° C.; Example 7, 68° C.; Example 8, 80° C.; Example 9, 81° C.; Example 10, 70° C.; and Example 11, 79° C.

U.S. Pat. No. 6,290,734 (Scott et al.) describes a method for blending an unleaded US summer gasoline of specified maximum RVP, containing ethanol. Hydrocarbon base stocks and their blends are described, with and without specified volume percentages of ethanol. No limits are stated for maximum percentages either of olefins having at least 10 carbon atoms or of aromatics having at least 10 carbon atoms. The objects stated are to overcome handling and transportation problems associated with gasolines containing ethanol, and to provide a gasoline formulation containing ethanol which meets the USA's California code of Regulations. Distillation data and overall percentages of different types of hydrocarbon are given for a range of examples, but no engine testing is described.

US Patent Application 2002/0068842 (Brundage et al.) describes certain gasoline compositions which are substantially free of oxygenates and are in compliance with USA's California Predictive Model. Such gasolines are described as being suitable for the US winter season. Distillation data is given (without any initial boiling points) for a range of examples, but no data or limits for percentages either of olefins having at least 10 carbon atoms or of aromatics having at least 10 carbon atoms. No engine testing is described.

U.S. Pat. Nos. 5,288,393, 5,593,567, 5,653,866, 5,837,126, and 6,030,521 (Jessup et al.) describe gasoline compositions with properties controlled for reduction of emissions of Nox, CO and/or hydrocarbons when used as fuel in spark-ignition engines. Reduction of olefin content is described as desirable ("preferably to essentially zero volume percent", Column 2 line 31 of U.S. Pat. No. 5,288,393). Whilst tables of examples give $T_{10}$, $T_{50}$ and $T_{90}$ data, values for initial boiling point and final boiling point are not given, and there is no teaching as to maximum percentages either of olefins having at least 10 carbon atoms or of aromatics having at least 10 carbon atoms.

US Patent Application 2002/0143216 (Tsurutani et al.) discloses a gasoline composition which is said to control formation of deposits in air intake systems and combustion of gasoline engines, keeping them clean without a detergent, although certain detergents may be present. The gasoline composition is required to contain saturated hydrocarbons, aromatic hydrocarbons having a carbon number of 7 or less and aromatic hydrocarbons having a carbon number of 8 or more, such that a controlling index A/B is greater than 6 is fulfilled, where A is total content (wt %) of saturated hydrocarbons plus aromatic hydrocarbons having a carbon of 7 or less, and B is total content (wt %) of aromatic hydrocarbons having a carbon number of 8 or more. Whilst examples are given, there is no disclosure in relation to olefin content, no mention of a content of olefins of at least 10 carbon atoms, and no teaching concerning aromatics of at least 10 carbon atoms, although some examples have less than 5% v aromatics of at least 10 carbon atoms since they have less than 2% w of aromatics of 8 carbon atoms or more.

WO 03/016438 (Fortum 0YJ) describes a gasoline fuel composition having in combination: an octane value (R+M)/2 of at least 85, an aromatics content less than 25% v, a water-soluble ethers content less than 1% v, a 10% D-86 distillation point no greater than 150° F. (65.6° C.), a 50% D-86 distillation point no greater than 230° F. (110° C.), a 90% D-86 distillation point no greater than 375° F. (190.6° C.), Reid Vapour Pressure of less than 9.0 psi (62 kPa), a content of light olefins, with a boiling point below 90° C., of less than 6% v, and a combined content of trimethylpentenes, trimethylhexanes and trimethylheptanes greater than 1% v. These fuels are said to reduce the emissions of an automotive engine of one or more pollutants selected from the group consisting of CO, NOx, particulates and hydrocarbons. There is no specific disclosure in WO 03/016438 of any restrictions on content of olefins of at least 10 carbon atoms, and/or of aromatics of at least 10 carbon atoms.

According to the present invention there is provided a gasoline composition comprising a hydrocarbon base fuel containing 5 to 20% v olefins, not greater than 5% v olefins of at least 10 carbon atoms, not greater than 5% v aromatics of at least 10 carbon atoms, initial boiling point in the range 24 to 45° C., $T_{10}$ in the range 38 to 60° C., $T_{50}$ in the range 77 to 110° C., $T_{90}$ in the range 130 to 190° C. and final boiling point not greater than 220° C.

It has now been found to provide gasoline compositions meeting certain parameters whose use as a fuel in a spark ignition engine results in improved stability of engine crank case lubricant.

Olefin content together with the $T_{10}$ range of 38 to 60° C. are believed to be key parameters in achieving enhanced stability of engine lubricant (crank-case lubricant), in engines fuelled by gasoline compositions of the present invention. Frequent engine stops and starts—short journeys in which crank-case lubricant does not fully warm up—represent severe conditions for oxidation of the lubricant. High front-end volatility (low $T_{10}$,) and specified olefin content are believed to result in reduction in blowby of harmful combustion gases into the engine crank-case.

By "not greater than 5% v olefins of at least 10 carbon atoms" and "not greater than 5% v aromatics of at least 10 carbon atoms" is meant that the hydrocarbon base fuel contains amounts of olefins having 10 carbon atoms or more and amounts of aromatics having 10 carbon atoms or more, respectively in the range 0 to 5% v, based on the base fuel.

Gasolines contain mixtures of hydrocarbons, the optimal boiling ranges and distillation curves thereof varying according to climate and season of the year. The hydrocarbons in a gasoline as defined above may conveniently be derived in known manner from straight-run gasoline, synthetically-produced aromatic hydrocarbon mixtures, thermally or catalytically cracked hydrocarbons, hydrocracked petroleum fractions or catalytically reformed hydrocarbons and mixtures of these. Oxygenates may be incorporated in gasolines, and these include alcohols (such as methanol, ethanol, isopropanol, tert.butanol and isobutanol) and ethers, preferably ethers containing 5 or more carbon atoms per molecule, e.g. methyl tert.butyl ether (MTBE) or ethyl tert.butyl ether (ETBE). The ethers containing 5 or more carbon atoms per molecule may be used in amounts up to 15% v/v, but if methanol is used, it can only be in an amount up to 3% v/v, and stabilisers will be required. Stabilisers may also be needed for ethanol, which may be used up to 5% to 10% v/v. Isopropanol may be used up to 10% v/v, tert-butanol up to 7% v/v and isobutanol up to 10% v/v.

It is preferred to avoid inclusion of tert.butanol or MTBE. Accordingly, preferred gasoline compositions of the present invention contain 0 to 10% by volume of at least one oxygenate selected from methanol, ethanol, isopropanol and isobutanol.

Theoretical modelling has suggested that inclusion of ethanol in gasoline compositions of the present invention will further enhance stability of engine lubricant, particularly under cooler engine operating conditions. Accordingly, it is preferred that gasoline compositions of the present invention contain up to 10% by volume of ethanol, preferably 2 to 10% v, more preferably 4 to 10% v, e.g. 5 to 10% v ethanol.

Gasoline compositions according to the present invention are advantageously lead-free (unleaded), and this may be required by law. Where permitted, lead-free anti-knock compounds and/or valve-seat recession protectant compounds (e.g. known potassium salts, sodium salts or phosphorus compounds) may be present.

The octane level, (R+M)/2, will generally be above 85.

Modern gasolines are inherently low-sulphur fuels, e.g. containing less than 200 ppmw sulphur, preferably not greater than 50 ppmw sulphur.

Hydrocarbon base fuels as define above may conveniently be prepared in known manner by blending suitable hydrocarbon, e.g. refinery, streams in order to meet the defined parameters, as will readily be understood by those skilled in the art. Olefin content may be boosted by inclusion of olefin-rich refinery streams and/or by addition of synthetic components such as diisobutylene, in any relative proportions.

Diisobutylene, also known as 2,4,4-trimethyl-1-pentene (Sigma-Aldrich Fine Chemicals), is typically a mixture of isomers (2,4,4-trimethyl-1-pentene and 2,4,4-trimethyl-2-pentene) prepared by heating the sulphuric acid extract of isobutylene from a butene isomer separation process to about 90° C. As described in Kirk-Othmer, "Encyclopedia of Chemical Technology", $4^{th}$ Ed. Vol. 4, Page 725, yield is typically 90%, of a mixture of 80% dimers and 20% trimers.

Gasoline compositions as defined above may variously include one or more additives such as anti-oxidants, corrosion inhibitors, ashless detergents, dehazers, dyes, lubricity improvers and synthetic or mineral oil carrier fluids. Examples of suitable such additives are described generally in DE-A-19955651 and U.S. Pat. No. 5,855,629 which disclosure is hereby incorporated by reference.

Additive components can be added separately to the gasoline or can be blended with one or more diluents, forming an additive concentrate, and together added to base fuel.

Preferred gasoline compositions of the invention have one or more of the following features:—

(i) the hydrocarbon base fuel contains at least 10% v olefins,
(ii) the hydrocarbon base fuel contains at least 12% v olefins,
(iii) the hydrocarbon base fuel contains at least 13% v olefins,
(iv) the hydrocarbon base fuel contains up to 20% v olefins,
(v) the hydrocarbon base fuel contains up to 18% v olefins,
(vi) the base fuel has initial boiling point (IBP) of at least 28° C.,
(vii) the base fuel has IBP of at least 30° C.,
(viii) the base fuel has IBP up to 42° C.,
(ix) the base fuel has IBP up to 40° C.,
(x) the base fuel has $T_{10}$ of at least 42° C.,
(xi) the base fuel has $T_{10}$ of at least 45° C.,
(xii) the base fuel has $T_{10}$ of at least 46° C.,
(xiii) the base fuel has $T_{10}$ up to 58° C.,
(xiv) the base fuel has $T_{10}$ up to 57° C.,
(xv) the base fuel has $T_{10}$ up to 56° C.,
(xvi) the base fuel has $T_{10}$ of at least 80° C.,
(xvii) the base fuel has $T_{10}$ of at least 82° C.,
(xviii) the base fuel has $T_{10}$ of at least 83° C.,
(xix) the base fuel has $T_{10}$ up to 105° C.,
(xx) the base fuel has $T_{10}$ up to 104° C.,
(xxi) the base fuel has $T_{10}$ up to 103° C.,
(xxii) the base fuel has $T_{90}$ at least 135° C.,
(xxiii) the base fuel has $T_{90}$ of at least 140° C.,
(xxiv) the base fuel has $T_{90}$ of at least 142° C.,
(xxv) the base fuel has $T_{90}$ up to 170° C., (xxvi) the base fuel has $T_{90}$ up to 150° C.,
(xxvii) the base fuel has $T_{90}$ up to 145° C.,
(xxviii) the base fuel has $T_{90}$ up to 143° C.,
(xxix) the base fuel has final boiling point (FBP) not greater than 200° C.,
(xxx) the base fuel has FBP not greater than 195° C.,
(xxxi) the base fuel has FBP not greater than 190° C.,
(xxxii) the base fuel has FBP not greater than 185° C.,
(xxxiii) the base fuel has FBP not greater than 180° C.,
(xxxiv) the base fuel has FBP not greater than 175° C.,
(xxxv) the base fuel has FBP not greater than 172° C.,
(xxxvi) the base fuel has FBP of at least 165° C., and
(xxxvii) the base fuel has FBP of at least 168° C.

Examples of preferred combinations of the above features include (i) and (iv); (ii) and (v); (iii) and (v); (vi), (viii), (x), (xii), (xvi), (xix), (xxii), (xxv) and (xxix); (vii), (ix), (xi), (xiv), (xvii), (xx), (xxiii), (xxvi) and (xxxiii); and (vii), (ix), (xii), (xv), (xviii), (xxi), (xxiv), (xxviii), (xxxvi) and (xxxvii).

The present invention further provides a method of operating an automobile powered by a spark-ignition engine, which comprises introducing into the combustion chambers of said engine a gasoline composition as defined above.

Use of the gasoline composition as fuel for a spark-ignition engine can give one of a number of benefits, including improved stability of engine lubricant (crank-case lubricant), leading to reduced frequency of oil changes, reduced engine wear, e.g. engine bearing wear, engine component wear (e.g. camshaft and piston crank wear), improved acceleration performance, higher maximum power output, and/or improved fuel economy.

Accordingly, the invention provides use of a gasoline composition of the invention as defined above as a fuel for a spark-ignition engine for improving oxidative stability of engine crank case lubricant and/or for reducing frequency of engine lubricant changes.

The invention will be understood from the following illustrative embodiment, which is provided for illustration only and is not to be construed as limiting the claimed invention in any way. Unless indicated otherwise, temperatures are in degrees Celsius and parts, percentages and ratios are by volume. Those skilled in the art will readily appreciate that the various fuels were prepared in known manner from known refinery streams and are thus readily reproducible from a knowledge of the composition parameters given.

In the examples, oxidative stability tests on lubricant in engines fuelled by test fuels were effected using the following procedure.

A bench engine, Renault Mégane (K7M702) 1.6 1, 4-cylinder spark-ignition (gasoline) engine was modified by honing to increase cylinder bore diameter and grinding ends of piston rings to increase butt gaps, in order to increase rate of blow-by of combustion gases. In addition, a by-pass pipe was fitted between cylinder head wall, above the engine valve deck, and the crankcase to provide an additional route for blow-by of combustion gases to the crank case. A jacketed rocker arm cover (RAC) was fitted to facilitate control of the environment surrounding the engine valve train.

Before test and between each test, the engine was cleaned thoroughly, to remove all trace of possible contamination. The engine was then filled with 15W/40 engine oil meeting API SG specification, and the cooling systems, both for engine coolant and RAC coolant, were filled with 50:50 water:antifreeze mixture.

Engine tests were run for 7 days according to a test cycle wherein each 24 hour period involved five 4-hour cycles according to Table 1:—

TABLE 1

| Control Parameters | Stage 1 | Stage 2 | Stage 3 |
|---|---|---|---|
| Duration (mins) | 120 | 75 | 45 |
| Speed (rpm) | 2500 ± 11 | 2500 ± 11 | 850 ± 100 |
| Torque (Nm) | 70 ± 3 | 70 ± 3 | 0 |
| Oil inlet ° C. | 69 ± 2 | 95 ± 2 | 46 ± 2 |
| Coolant ° C. | 52 ± 2 | 85 ± 2 | 46 ± 2 |
| RAC inlet ° C. | 29 ± 2 | 85 ± 2 | 29 ± 2 |

followed by an oil sampling cycle wherein Stage 3 of Table 1 was replaced by a modified stage in which during a 10 min idle period (850±100 rpm) a 25 g oil sample was removed. (Every second day and on the seventh day (only) was sample removed). The engine was then stopped and allowed to stand for 20 minutes. During the next 12 minutes the oil dipstick reading was checked and engine oil was topped up (only during test, not at end of test). During the final 3 minutes of this 45-minute stage the engine was restarted.

Test measurements on oil samples were made to assess heptane insolubles (according to DIN 51365 except that oleic acid was not used as coagulant), total acid number (TAN) (according to IP177), total base number (TBN) (according to ASTM D4739), and amounts of wear metals (Sn, Fe and Cr) (according to ASTM 5185 except that sample was diluted by a factor of 20 in white spirit, instead of a factor of 10). From the TAN and TBN values (units are mg KOH/g lubricant), TAN/TBN crossover points were calculated (test hours).

EXAMPLE 1

Three hydrocarbon base fuel gasolines were tested. Comparative Example A was a base fuel as widely employed in fuels sold in The Netherlands in 2002. Comparative Example B corresponded to Comparative Example A with addition of heavy platformate (the higher boiling fraction of a refinery steam manufactured by reforming naphtha over a platinum catalyst), to increase aromatics. Example 1 corresponded to Comparative Example A, with addition of light cat-cracked gasoline (the lower boiling fraction of a refinery stream produced by catalytic cracking of heavier hydrocarbons), to increase olefins. Sulphur contents of the fuels were adjusted to 50 ppmw S by addition, where necessary, of dimethylsulphide, in order to eliminate possible effects arising from differences in sulphur levels.

The resulting fuels had properties as given in Table 2:—

TABLE 2

| Base Fuel | Example 1 | Comparative Example A | Comparative Example B |
|---|---|---|---|
| Density at 15° C. DIN 51757/V4 | 0.7216 | 0.7316 | 0.754 |
| RVP (mbar) | 561 | 512 | 672 |
| Distillation (ISO 3405/88) | | | |
| IBP (° C.) | 30 | 32.5 | 35 |
| 10% | 46 | 49.5 | 54 |
| 50% | 83.5 | 107.5 | 109.5 |
| 90% | 143 | 147.5 | 168.5 |
| FBP | 168.5 | 173 | 205.5 |
| S(ASTM D 2622-94) (ppmw) | 50 | 50 | 50 |
| Paraffins (% v) | 52.86 | 64.19 | 53.79 |
| Olefins (% v) | 16.4 | 0.61 | 0.43 |
| Olefins of C10 or greater % v) | 0.00 | 0.00 | 0.00 |

TABLE 2-continued

| Base Fuel | Example 1 | Comparative Example A | Comparative Example B |
|---|---|---|---|
| Naphthenes (% v) (saturated) | 2.87 | 2.88 | 4.1 |
| Aromatics (% v) | 27.01 | 31.41 | 40.74 |
| Aromatics of C10 or greater (% v) | 0.46 | 0.57 | 7.10 |
| Oxygenates | 0 | 0 | 0 |
| RON | 95.3 | 96.1 | 95.8 |
| MON | 85.3 | 87.7 | 86.6 |

Results of tests on these fuels are given in Table 3:—

TABLE 3

| Base Fuel | Example 1 | Comparative Example A | Comparative Example B |
|---|---|---|---|
| TAN/TBN crossover (hours) | 101 | 47 | 50 |
| Wear Metals (mg metal/g lubricant) | | | |
| Cr (after 96 hours) | less than 1 | less than 1 | less than 1 |
| Cr (after 7 days) | less than 1 | less than 1 | less than 1 |
| Fe (after 96 hours) | 14 | 15 | 17 |
| Fe (after 7 days) | 18 | 23 | 22 |
| Sn (after 96 hours) | 4 | 8 | 14 |
| Sn (after 7 days) | 4 | 11 | 15 |

The point at which TAN/TBN crossover occurs is considered to be an indicator of the point at which significant oxidative change is occurring in the oil.

The above results give a good indication that use of the fuel of Example 1 had a highly beneficial effect on oxidative stability of the crank case lubricant, leading to extended lubricant life, lower frequency of engine lubricant changes (extended service intervals), and reduced engine wear.

Tin levels are most likely to be associated with wear in engine bearings. Iron levels are associated with engine component wear (camshaft and piston cranks).

EXAMPLES 2 AND 3

Four hydrocarbon base fuel gasolines were tested. Comparative Example C was a base fuel as widely employed in fuels sold in The Netherlands in 2002. Comparative Example D corresponded to Comparative Example C with addition of heavy platformate, to increase aromatics. Example 1 corresponded to Comparative Example C, with addition of 15 parts by volume diisobutylene per 85 parts by volume base fuel of Comparative Example C. The diisobutylene was a mixture of 2,4,4-trimethyl-1-pentene and 2,4,4-trimethyl-2-pentene, in proportions resulting from commercial manufacture. Example 3 corresponded to Comparative Example C, with addition of an ex-refinery stream of $C_5$ and $C_6$-olefins, in proportion of 15 parts by volume olefins per 85 parts by volume base fuel of Comparative Example C.

The resulting fuels had properties as given in Table 4:

TABLE 4

| Base Fuel | Example 2 | Example 3 | Comparative Example C | Comparative Example D |
|---|---|---|---|---|
| Density at 15° C. DIN 51757/V4 | 0.7263 | 0.7232 | 0.7321 | 0.7557 |
| RVP (mbar) | 516 | 625 | 561 | 508 |

TABLE 4-continued

| Base Fuel | Example 2 | Example 3 | Comparative Example C | Comparative Example D |
|---|---|---|---|---|
| Distillation (ISO 3405/88) | | | | |
| IBP (° C.) | 35 | 32 | 35 | 35 |
| 10% | 56 | 46.5 | 51.5 | 57 |
| 50% | 102.5 | 87.5 | 105.5 | 105.5 |
| 90% | 142 | 143 | 146 | 166 |
| FBP | 172 | 170.5 | 174.5 | 196.5 |
| S (ASTM D 2622-94) (ppmw) | 23 | 23 | 24 | 14 |
| paraffins (% v) | 57.08 | 55.6 | 64.25 | 53.63 |
| olefins (% v) | 17.97 | 17.63 | 3.33 | 1.92 |
| olefins of C10 or greater (% v) | 0.00 | 0.00 | 0.00 | 0.00 |
| naphthenes (% v) (saturated) | 2.74 | 1.93 | 1.89 | 4.14 |
| aromatics (% v) | 22.21 | 24.84 | 28.2 | 40.3 |
| aromatics of C10 or greater (% v) | 0.57 | 0.98 | 1.33 | 6.83 |
| oxygenates | 0 | 0 | 0 | 0 |
| RON | 98.5 | 96.2 | 96.1 | 95.9 |
| MON | 87.6 | 85.9 | 87.7 | 86.5 |

Results of tests on these fuels are given in Table 5:

TABLE 5

| Base Fuel | Example 2 | Example 3 | Comparative Example C | Comparative Example D |
|---|---|---|---|---|
| TAN/TBN crossover (hours) | 100 | 127 | 100 | 68 |
| Wear Metals (mg metal/g lubricant) | | | | |
| Cr (after 96 hours) | less than 1 | less than 1 | less than 1 | 3 |
| Cr (after 7 days) | less than 1 | less than 1 | less than 1 | 4 |
| Fe (after 96 hours) | 9 | 12 | 12 | 16 |
| Fe (after 7 days) | 11 | 13 | 16 | 21 |
| Sn (after 96 hours) | 5 | 5 | 8 | 4 |
| SN (after 7 days) | 6 | 6 | 10 | 6 |
| Heptane insolubles (after 96 hours) (% w/w) | 0.08 | 0.08 | 0.11 | 0.42 |
| Heptane insoluble (after 7 days) (% w/w) | 0.14 | 0.23 | 0.24 | 0.83 |

The above results overall give a good indication that use of the fuels of Examples 2 and 3 give overall unexpected benefits on oxidative stability of the crank case lubricant, with similar consequences as described above in Example 1.

EXAMPLE 4

A fuel similar to Comparative Example C (Comparative Example E) was blended with diisobutylene and ethanol to give a gasoline composition containing 10% v/v diisobutylene and 5% v/v ethanol (Example 4). The resulting gasoline contained 13.02% v olefins, had initial boiling point 40° C., final boiling point 168.5° C., and met the other parameters of the present invention. This fuel was tested in a Toyota Avensis 2.0 l VVT-i direct injection spark-ignition engine relative to Comparative Example E and relative to the same base fuel containing 5% v/v ethanol (Comparative Example F). Both Comparative Example E and Comparative Example F are outside the parameters of the present invention by virtue of their olefin contents (total olefins of 3.51% v/v and 3.33% v/v, respectively). Details of the fuels are given in Table 6:

TABLE 6

| Base Fuel | Example 4 | Comparative Example E | Comparative Example F |
|---|---|---|---|
| Density at 15° C. DIN 51757/V4 | 0.7348 | 0.7333 | 0.7359 |
| Distillation (ISO 3405/88) | | | |
| IBP (° C.) | 40 | 38 | 35.5 |
| 10% | 52.5 | 55 | 50 |
| 50% | 100.5 | 101 | 97.5 |
| 90% | 138.5 | 142 | 141 |
| FBP | 168.5 | 169 | 167 |
| S (IP 336/95) (ppmw) | 26 | 26 | 25 |
| paraffins (% v) | 52.16 | 61.36 | 58.1 |
| olefins (% v) | 13.02 | 3.51 | 3.33 |
| olefins of C10 or greater (% v) | 0 | 0 | 0 |
| naphthenes (% v) (saturated) | 2.13 | 2.58 | 2.49 |
| aromatics (% v) | 26.62 | 31.93 | 30.15 |
| aromatics of C10 or greater (% v) | 0.49 | 0.59 | 0.55 |
| oxygenates | 5.54 | 0 | 5.47 |
| RON | 99.7 | 95.2 | 97.5 |
| MON | 87.8 | 87.1 | 87.6 |

Under acceleration testing (1200-3500 rpm, 5th gear, wide open throttle (WOT), 1200-3500 rpm, 4th gear, WOT, and 1200-3500 rpm, 4th gear 75% throttle), Example 4 gave consistently superior performance (acceleration time) relative to either of Comparative Examples E and F. Significantly higher power was developed both at 1500 rpm and at 2500 rpm when the engine was fuelled with Example 4, relative to Comparative Example E or Comparative Example F.

I claim:

1. A gasoline composition comprising a hydrocarbon base fuel containing 10 to 20% v olefins, not greater than 5% v olefins of at least 10 carbon atoms, based on the base fuel, not greater than 5% v aromatics of at least 10 carbon atoms, based on the base fuel, initial boiling point in the range 24 to 45° C., $T_{10}$ in the range 38 to 60° C., $T_{50}$ in the range 77 to 110° C., $T_{90}$ in the range 130 to 190° C. and final boiling point not greater than 220° C.

2. The gasoline composition of claim 1 further comprising 0 to 10%v of at least one oxygenate selected from methanol, ethanol, isopropanol and isobutanol.

3. The gasoline composition of claim 1 wherein the hydrocarbon base fuel contains 12 to 18% v olefins.

4. The gasoline composition of claim 1 wherein the base fuel has initial boiling point in the range 28 to 42° C., $T_{10}$ in the range 42 to 58° C., $T_{50}$ in the range 80 to 105° C., $T_{90}$ in the range 135 to 170° C. and final boiling point not greater than 200° C.

5. The gasoline composition of claim 4 further comprising 0 to 10%v of at least one oxygenate selected from methanol, ethanol, isopropanol and isobutanol.

6. The gasoline composition of claim 4 wherein the hydrocarbon base fuel contains 12 to 18% v olefins.

7. The gasoline composition of claim 1 wherein the base fuel has initial boiling point in the range 30 to 40° C., $T_{10}$ in the range 45 to 57° C., $T_{50}$ in the range 82 to 104° C., $T_{90}$ in the range 140 to 150° C., and final boiling point not greater than 180° C.

8. A method of operating an automobile powered by a spark-ignition engine comprising introducing into the combustion chambers of said engine a gasoline composition of claim 1.

9. A method of operating an automobile powered by a spark-ignition engine comprising introducing into the combustion chambers of said engine a gasoline composition of claim 2.

10. A method of operating an automobile powered by a spark-ignition engine comprising introducing into the combustion chambers of said engine a gasoline composition of claim 4.

11. A method of operating an automobile powered by a spark-ignition engine comprising introducing into the combustion chambers of said engine a gasoline composition of claim 5.

* * * * *